US005210961A

United States Patent [19]

Jacobs et al.

[11] Patent Number: 5,210,961

[45] Date of Patent: May 18, 1993

[54] DRIER WITH IMPROVED CONFIGURATION OF THE AIR DUCTS

[75] Inventors: Thomas G. M. Jacobs, Cuijk; Clemens J. M. de Vroome, Beugen, both of Netherlands

[73] Assignee: Stork Contiweb B.V., Boxmeer, Netherlands

[21] Appl. No.: 614,852

[22] Filed: Nov. 14, 1990

[30] Foreign Application Priority Data

Nov. 15, 1989 [NL] Netherlands ..... 8902825

[51] Int. Cl.[5] ..... F26B 13/00

[52] U.S. Cl. ..... 34/155; 34/156; 226/199

[58] Field of Search ..... 34/155, 156, 160, 23, 34/151-152; 226/97, 199

[56] References Cited

U.S. PATENT DOCUMENTS

| | | | |
|---|---|---|---|
| 3,638,330 | 2/1972 | Stout | 34/156 |
| 3,739,491 | 6/1973 | Creapo et al. | 34/156 |
| 3,873,013 | 3/1975 | Stibbe | 34/156 |
| 4,216,591 | 8/1980 | Bubley | 34/18 |
| 4,292,745 | 10/1981 | Caratsch | 34/156 |
| 4,320,587 | 3/1982 | Vits | 34/156 |
| 4,341,024 | 7/1982 | Witkin | 34/156 |
| 4,425,719 | 1/1984 | Klein et al. | 34/155 |
| 4,474,496 | 10/1984 | Rocheleau | 34/156 |
| 4,767,042 | 8/1988 | Daane | 34/156 |
| 4,787,547 | 11/1988 | Hella et al. | 34/156 |
| 4,944,098 | 7/1990 | Hella et al. | 34/156 |

FOREIGN PATENT DOCUMENTS

| | | |
|---|---|---|
| 329498 | 5/1976 | Austria . |
| 2934967 | 3/1980 | Fed. Rep. of Germany . |
| 2908348 | 9/1980 | Fed. Rep. of Germany . |
| 8702432 | 4/1987 | Fed. Rep. of Germany . |

*Primary Examiner*—Henry A. Bennet
*Assistant Examiner*—Denise Gomada
*Attorney, Agent, or Firm*—Webb, Burden, Ziesenheim & Webb

[57] ABSTRACT

The invention relates to a drier for elongate strips of material, wherein a fan for supplying a drying gas mixture to an array of nozzles is not located in the same height as the nozzles, as is common in the field of driers to allow supply of drying gas to the nozzles with a minimal amount of curves in the supply path. Instead thereof the fan is located above or below the nozzles to save ground area, and nevertheless maintaining a feed path towards the nozzles with a minimal amount of curves.

19 Claims, 3 Drawing Sheets

DRIER WITH IMPROVED CONFIGURATION OF THE AIR DUCTS

The present invention relates to a drier for elongate strips of carrier material, comprising at least one row of nozzles which extend in the transverse direction of the strips for drying and which are provided with a feed opening on at least one side for feeding a drying gas mixture, wherein the feed openings are connected to at least one feed duct extending adjacently to the nozzles and located in the line of the outflow opening of at least one fan supplying a drying gas mixture.

Such a drier is known from AT-B-329498.

In this known drier the fan is placed directly in the line of the feed duct. The nozzles present at the position of this fan can therefore not be supplied from this fan. In this known device a feed duct is arranged for this purpose on both sides of the series of nozzles in addition to a fan supplying this feed duct.

As a consequence the width of this known drier is large.

It is of course possible to place the fan in the line of the feed duct outside the region covered by the nozzles. In such a case, however, the length of such a drier becomes quite great.

The object of the present invention is to provide a drier which occupies a small ground surface area and which has a compact construction.

This object is achieved in that the at least one fan is located outside the region enclosed by the horizontal planes between which the series of nozzles is situated.

As a result of these steps it is possible to supply all nozzles with hot gases using one feed duct since the duct can extend over the whole active length of the nozzles and no extra length is therefore necessary for the fan. Nor is it necessary to arrange a duct on both sides of the series of nozzles, so that the total width of the machine is not increased either.

In the drier according to the invention the fan is of course placed either above or below the series of nozzles. With respect to the fact that a certain construction height is necessary to accommodate the burners and other auxiliary appliances, it is generally not necessary to enlarge the construction height of such a drier through placing of the fans according to the present invention.

According to a preferred embodiment the duct has at least partially an L- or U-shaped section, a portion of the section extends above and/or below the nozzles and the fan is positioned partially above and/or below the nozzles.

Due to this embodiment a portion of the section of the duct can be arranged above and/or below the nozzles, as can the fan. The breadth of the portion of the duct located adjacent to the nozzles is hereby reduced still further so that an additional space saving is achieved.

According to a particular embodiment the feed duct and the at least one fan are arranged on the drive side of the drier.

This has the advantage that the nozzles are directly accessible from the other side since no feed duct is fixed in front of them.

The present invention will be elucidated hereinafter with reference to the annexed drawings, wherein.

Figure 1:
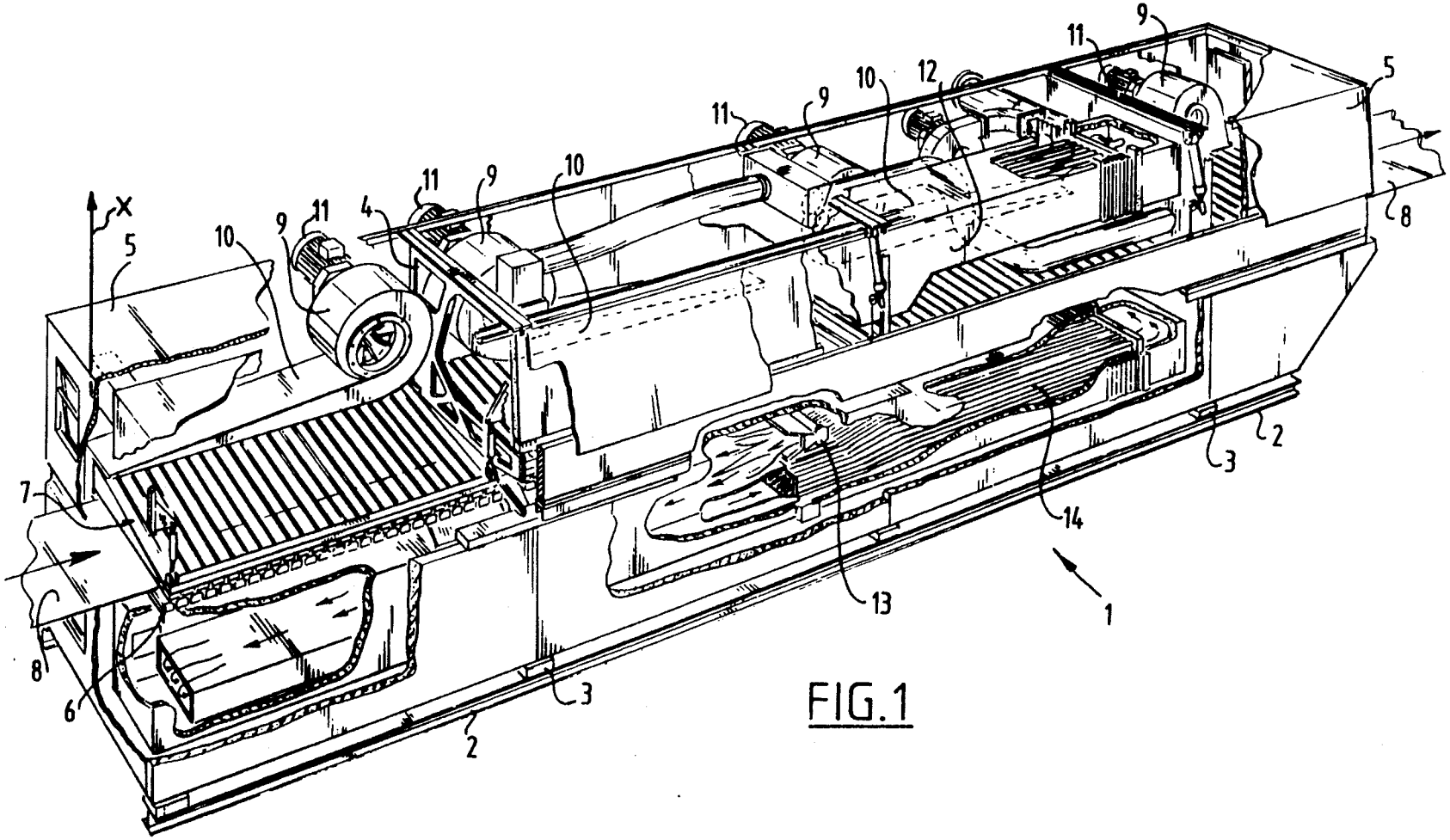
FIG. 1 shows a perspective, partly broken away view of a drier according to the present invention.

The drier 1 shown in FIG. 1 rests by means of blocks 3 on a foundation construction 2. The drier 1 is essentially formed by a frame designated in its entirety with 4 around which is arranged a casing 5 and inside which the relevant components are arranged.

Thus arranged in frame 4 are two rows of nozzles 6, 7 between which the strip of material 8 for drying is fed through. The lower row of nozzles 6 is herein arranged fixedly in the frame, while the upper row 7 is pivotable about hinges arranged on the side of the strip for drying generally designated as drive side, which hinges will be further elucidated with reference to FIG. 2.

A series of fans 9 is further arranged in the space above the nozzles 7. Connecting directly onto the outlet opening of each fan 9 is a feed duct 10 for supplying drying gas mixture, generally air, coming from the fan 9 to the nozzles. Both the fans 9 and the feed ducts 10 connected thereto are arranged, as seen in the transport direction of the strip 8 for drying, on the side generally designated as drive side of the drier. Each fan 9 is otherwise driven by an electromotor 11.

The passage area of the feed ducts 10 continually decrease as the distance from the respective fans 9 increase.

Arranged in corresponding manner on the underside of the fixedly arranged nozzles 6 are similar fans which are connected via similar feed ducts onto the relevant nozzles. Neither these fans nor these ducts are shown in FIG. 1.

Further, nozzles 6 and 7 can be connected to a common feed duct.

As can be seen in FIG. 1 a great space saving is obtained through the above stated placing of the fans and associated outlet ducts; the space above the nozzles remains for the greater part free so that this space can be used for other elements such as a heat exchanger, which is designated with 12 in FIG. 1. Further indicated in FIG. 1 is how the space under the fixed series of nozzles 6 is used for fitting a burner 13 and a heat exchanger 14.

The feed duct 10 can also have an L-shaped section wherein portions of the feed duct 10 extend above and/or below the nozzles 6. Likewise, the U-shaped section or L-shaped section can extend partially above and/or below the fans 9.

Figure 2:
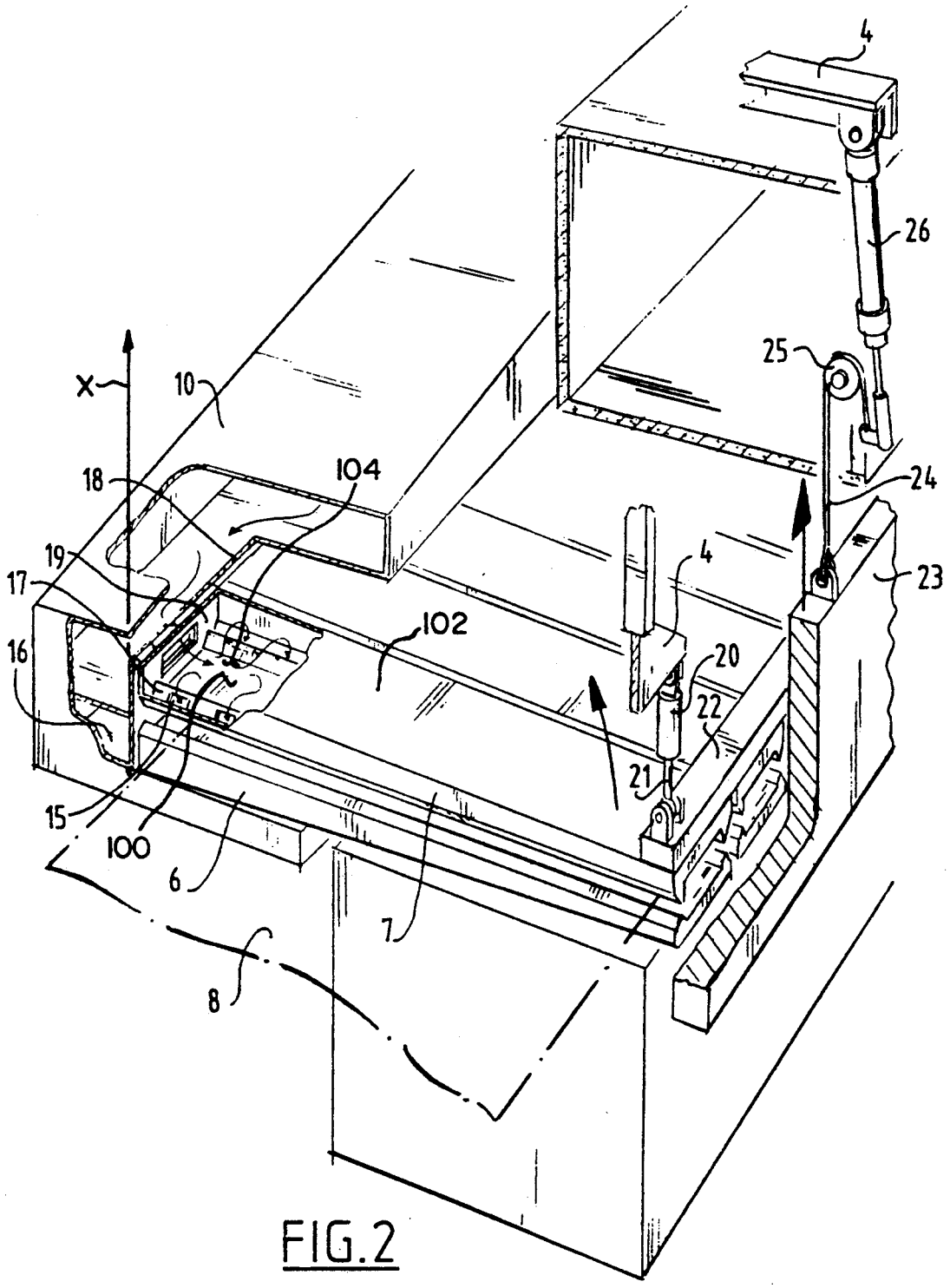
FIG. 2 is a partly broken away, perspective detail view of a drier according to the present invention.

The connection of the feed ducts 10 to the nozzles will now be elucidated with reference to FIG. 2. The feed duct 10 has a U-shaped section wherein portions of this feed duct 10 extend above and/or below the nozzles 6. The configuration of this feed duct 10 is such that it is a continuation or extension of the volute of the fans 9 so that the gas mixture leaving the fans 9 is supplied to the feed duct 10 without passing through bends.

Since the feed duct 10 extends at least partially wholly at the side of the series of nozzles 7 the gas mixture coming from the feed duct 10 only has to pass through one bend to enter the space of a nozzle 7. For passage from the nozzle 7 to the outflow openings 15 arranged therein, again only one bend has to be negotiated, so that, coming from the fan, the path to be followed by the drying air mixture comprises only two bends, namely one bend to enter the nozzle from the feed duct and one bend in order to be sprayed from the nozzle onto the strip 8 for drying via the spray orifice 15. It is noted here that due to the U-shape of the feed duct a part of the gas flow does not flow in an entirely straight line between, the outflow opening of the fan and the entrance or feed opening of the nozzles. The variation is small, however, and the bends thus created in the path are so slight that they cause little flow resistance.

Thus, the nozzles 7 are in fluid communication with the feed duct 10 through the respective feed openings and the fans 9 are in fluid communication with the duct 10 through the outflow opening. The fans 9 are located outside a region enclosed by horizontal planes between the respective row of nozzles.

A corresponding feed duct 16 is otherwise arranged for the lower row of nozzles 6. The fixedly arranged nozzles are herein constructed such that they are fixedly connected to the feed duct 16. The same considerations otherwise apply herefor as for the upper row.

The nozzles 7 are however tiltable, for which purpose they are connected to the feed duct 10 by means of a hinge 17. Arranged in the side wall 18 of the feed duct 10, as in the side wall 19 of the nozzle 7, is a passage opening through which the drying gas mixture moves. The construction is such that in the operating state, that is, the state wherein drying gas passes through the nozzles, both walls 18, 19 are joined to one another so that the total quantity of drying gas is transferred. In order to keep the flow resistance as small as possible the opening is embodied as large as possible. Nozzle 7 also includes a first end 100 and a second end 102. Side wall 19 is positioned between the first end 100 and the second end 102. The first end 100 is spaced apart from the second end 102 in a longitudinal direction X and the first end 100 is positioned closer to the strip of material 8 than second end 102. A nozzle region 104 is defined between the first end 100 and the second end 102. The fan 9 is located outside the nozzle region 106 in the longitudinal direction so that the fan 9 is positioned above or below the nozzle region 104.

Arranged for moving the nozzles 7 is a cylinder 20 of which the piston rod 21 is connected to the free ends of the nozzles 7 by means of a beam 22. The other end of cylinder 20 is fixed pivotally into the frame 4 of the drier. Through actuation of the for instance hydraulically or pneumatically operating cylinder 20, the beam 22 and therewith the free end of the pivotally attached nozzles 7 can be moved upward so that the free ends of the nozzle 7 can be temporarily enlarged for passage of the material for drying. This is employed for through-feed of the beginning of a strip of material for drying. The interval between the nozzles 7, 6 in the operating state is in any case so small that a user cannot place his fingers therein. In order to make the space accessible an upwardly movable hatch 23 is arranged in the casing 5 whereby in the upwardly moved position of the hatch an opening is made so that the user can reach into the space between the nozzles 6, 7. The hatch 23 can also be operated by means of a cable 24, a pulley 25 and a hydraulic or pneumatic cylinder 26.

Figure 3:
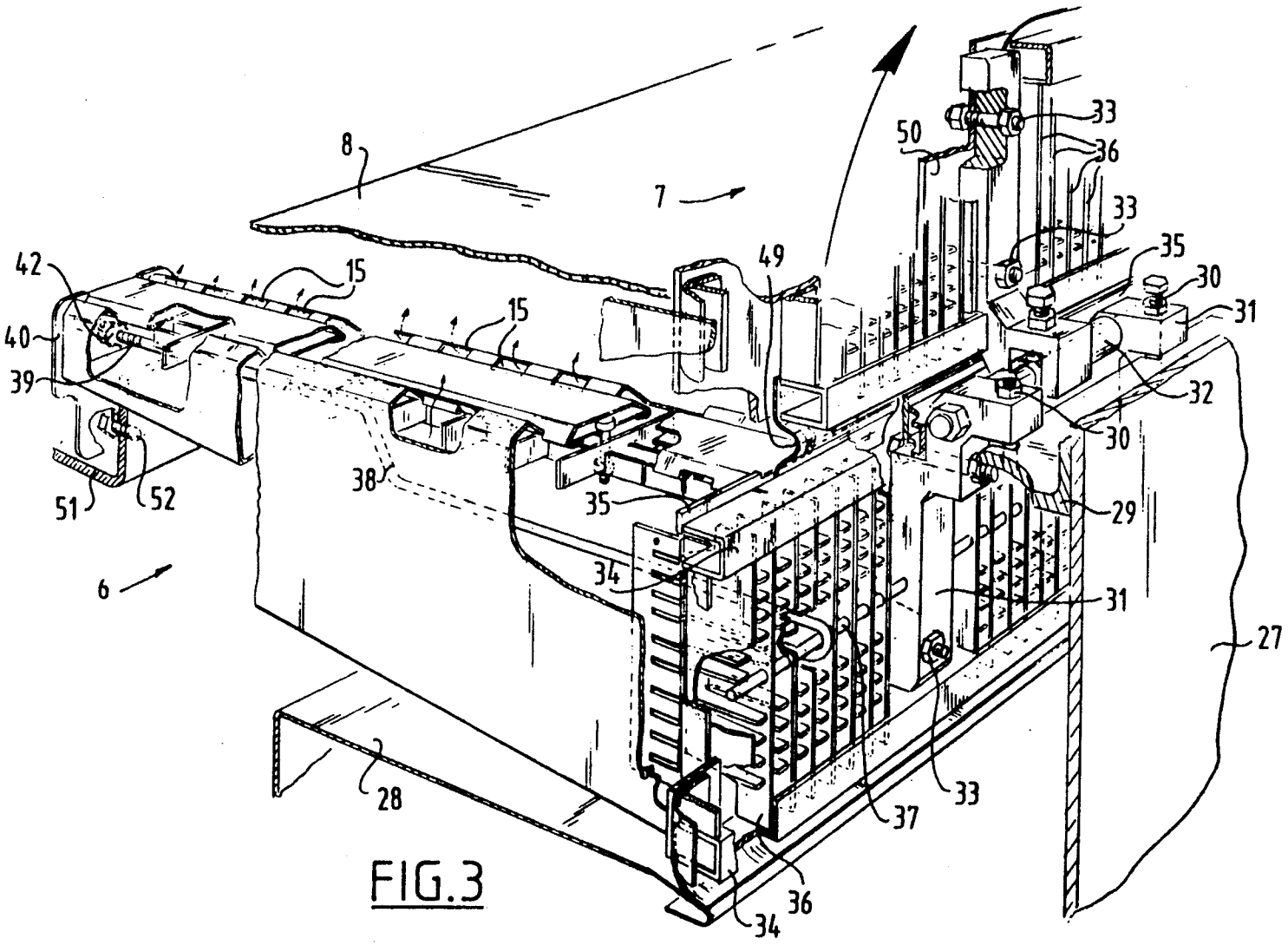
FIG. 3 is a partly broken away, perspective detail view of another embodiment of the fixing of the nozzles to the feed duct.

Depicted in FIG. 3 is how in accordance with another embodiment the nozzles are fixed to the relevant feed ducts 10, 16. To this end this plate is bent over on its vertical edges. One side wall of both feed ducts is herein formed by a plate 27 arranged on the drive side and having a structural strength such that the nozzles are attached thereto. Both feed ducts otherwise form a single feed duct; the drier is in any case symmetrical below and above the central plane between both series of nozzles. The feed ducts are further bounded by bent plates 28.

Fixed to the side wall 27 is an angle iron 29 on which two supports 31 are supported, each by means of a bolt 30. As a result of this construction the height of the supports 31 can be adjusted relative to the angle iron 29. Both supports 31 are connected by a shaft 32.

Further, a plate 35 is connected to both supports 31 by means of bolts 33. This plate extends over the whole length of the relevant section of the drier.

On both the top and bottom of plate 35 a U-profile 34 is arranged by means of bolts (not shown in the drawing). Between these two U-profiles 34 extends a number of vertical strips 36. These strips 36 have the function, as do the horizontally extending strips arranged therebetween, of guiding the air flow towards the nozzles. Arranged in each of these strips 36 in the middle is a hole through which extends a shaft 37. This shaft also extends through holes arranged in the supports 31.

In each of the fixed nozzles 6, the construction whereof will not be described extensively here, is arranged a rod 38 which extends substantially in lengthwise direction of nozzle 6. At the narrow, closed end of nozzle 6 screw thread 39 is arranged on the rod 38, wherein this screw thread extends through the end wall 40 of nozzle 6, while on the other side the rod 38 is provided with a piece 41 bent over in a U-shape. By means of the rod 38 the relevant nozzle 6 is fixed against the plate 35. To this end the nozzle 6 is maneuvered from the front, that is, the side of the end wall 40, against plate 35, while rod 38 is turned such that the U-shaped piece 41 thereof is hooked round the shaft 37. A nut 42 is subsequently tightened onto the screw thread 39 to fix the nozzle 6 against plate 35. Through this construction it is possible to mount or remove the nozzles 6, 7 from the service side of the drier. No further assembly operations are required for this purpose, so that the nozzles 6, 7 can easily be exchanged or cleaned. As is shown in the drawing, the head end walls of the nozzle 6 rest on a profile 51 into which they are fixed by means of a bolt 52.

Fixed on the underside of plate 35 is a strip of flexible sealing material in the form of spring steel which rests against the bent edge of plate 28 so that a good sealing for the drying gas mixture is achieved.

On the shaft 32 connecting the two supports 31 is arranged a square thickening 44, the corners of which are flattened off. Arranged grippingly hereon is a second support 45, wherein the height of support 45 can be changed relative to shaft 32 by means of a bolt 46 which is provided with a locking nut 47. The height of the movable nozzle 7 is herewith adjustable over the drive side.

The support 45 is connected by means of two bolts 48 to a plate 50 which corresponds to the plate 35 such as this is described with reference to the fixed nozzles 6. The construction of the tiltable nozzles 7 is further wholly similar to that of the fixed nozzles 6 such that this is not discussed further.

Such a construction is arranged for each pair of nozzles or for each group of nozzles so that a good supporting of the nozzles is obtained. A strip of flexible material 49 is further arranged between two U-profiles 34 for sealing.

It should otherwise be noted that the angle iron 29 does not extend over the full length of the relevant section, so that there are interruptions. Both feed ducts 10 and 16 are therefore connected to one another so that a good pressure distribution of the gas mixture is obtained.

We claim:

1. A drier for elongate strips of carrier material comprising:

a row of nozzles extending in the transverse direction of the strips for drying, each of said nozzles having a feed opening on at least one side for supplying a gas mixture, said nozzles having a first end and a second end, said side positioned between said first end and said second end, said first end is spaced apart from said second end in a longitudinal direction and said first end positioned closer to the strip than the second end wherein a nozzle region is defined between said first end and said second end;

a feed duct extending at least partially adjacently to said nozzles and side-by-side to said nozzles, and in fluid communication with said nozzles through said feed openings; and a fan for supplying the drying gas mixture having an outflow opening, said feed duct in fluid communication with and directly connected to said fan through said outflow opening wherein said fan is located outside the nozzle region in the longitudinal direction.

2. A drier as claimed in claim 1 having two rows of said nozzles between which the strip for drying is fed through, wherein both rows of said nozzles are connected to said feed duct.

3. A drier as claimed in claim 1 wherein the passage area of said feed duct continually decreases as the distance form the fan increases.

4. A drier as claimed in claim 1 wherein said feed duct and said fan are arranged on a drive side of said dryer.

5. A drier as claimed in claim 1 wherein said row of said nozzles is attached pivotally to the side of said ducts so that a space between said nozzles on another side thereof can be temporarily enlarged for passage of the carrier material for drying.

6. A drier as claimed in claim 1 wherein said nozzles are connected to a support joined to a sidewall by a connection fixable from another side of said nozzles, said connection formed by a rod having on one side a hook and on another side a fixation member, wherein said hook can grip onto a shaft which is connected to said support.

7. A drier as claimed in claim 1 wherein said nozzles are fixed on a drive side to a common support, said common support is attached to and adjustable relative to a sidewall.

8. A drier as claimed in claim 1 wherein said nozzles are fixed both to an auxiliary support and a common support, said auxiliary support is height adjustable relative to said common support.

9. A drier as claimed in claim 8 further comprising a strip of sealing material in the form of a strip of spring steel which rests on an edge of said feed duct for forming a seal for the drying gas mixture.

10. A drier as claimed in claim 1 wherein the duct has at least a partially L-shaped section.

11. A drier as claimed in claim 1 wherein the duct has at least a partially U-shaped section.

12. A drier as claimed in claim 10 wherein a part of the section extends above said nozzles.

13. A drier as claimed in claim 10 wherein a part of the section extends below said nozzles.

14. A drier as claimed in claim 10 wherein a part of the section extends partially above said fan.

15. A drier as claimed in claim 10 wherein a part of the section extends partially below said fan.

16. A drier as claimed in claim 11 wherein a part of the section extends above said nozzles.

17. A drier as claimed in claim 11 wherein a part of the section extends below said nozzles.

18. A drier as claimed in claim 11 wherein a part of the section extends partially above said fan.

19. A drier as claimed in claim 11, wherein a part of the section extends partially below said fan.

* * * * *